US005502290A

United States Patent [19]

Koyanagi et al.

[11] Patent Number: 5,502,290

[45] Date of Patent: Mar. 26, 1996

[54] SWITCH MECHANISM

[75] Inventors: Osamu Koyanagi; Kunio Hirasawa; Masanori Tsukushi; Yukio Kurosawa, all of Hitachi; Tadashi Sato, Mito; Youichi Ohshita, Katsuta, all of Japan

[73] Assignee: Hitachi, Ltd., Tokyo, Japan

[21] Appl. No.: 483,878

[22] Filed: Jun. 7, 1995

Related U.S. Application Data

[63] Continuation of Ser. No. 125,838, Sep. 24, 1993, abandoned, which is a continuation of Ser. No. 761,304, Sep. 17, 1991, abandoned.

[30] Foreign Application Priority Data

Sep. 17, 1990 [JP] Japan ..... 2-243734
Feb. 13, 1991 [JP] Japan ..... 3-019743

[51] Int. Cl.[6] ..... H01H 33/34

[52] U.S. Cl. ..... 218/78; 200/82 B; 218/84

[58] Field of Search ..... 200/82 B; 218/1, 218/43, 68, 78, 84, 91, 92, 93, 94, 99, 96, 153, 154; 361/604, 612

[56] References Cited

U.S. PATENT DOCUMENTS

| | | | |
|---|---|---|---|
| 3,633,067 | 1/1972 | Dubois | 315/149 |
| 3,885,454 | 5/1975 | Grieger et al. | 200/82 B X |
| 3,891,862 | 6/1975 | Clark | 307/125 |
| 4,032,820 | 6/1977 | Oishi et al. | 361/333 |
| 4,118,613 | 10/1978 | Barkan et al. | 200/82 B |
| 4,166,937 | 9/1979 | Imam et al. | 200/82 B |
| 4,384,182 | 5/1983 | Imam | 200/82 B |
| 4,417,111 | 11/1983 | Kishi et al. | 200/148 R |
| 4,461,937 | 7/1984 | Boni | 200/82 B |
| 4,514,607 | 4/1985 | Lloyd et al. | 200/150 A |
| 4,570,043 | 2/1986 | Lloyd et al. | 200/150 A |

FOREIGN PATENT DOCUMENTS

| | | | |
|---|---|---|---|
| 241816 | 10/1987 | European Pat. Off. | H01H 33/34 |
| 2 193243 | 2/1974 | France . | |
| 62-58092 | 12/1987 | Japan | H01H 33/34 |
| 1-220320 | 9/1989 | Japan | H01H 33/34 |

OTHER PUBLICATIONS

IEEE Transactions on Power Delivery, Y. Mukaiyama et al., "Development of a Perfluorocarbon Liquid Immersed Prototype Large Power Transformer with Compressed $SF_6$ Gas Insulation," vol 6, No. 3, Jul., 1991, pp. 1108–1116.

Hydraulic Pneumatic Power, vol. 20, No. 229, Jan. 1974, Manchester GB pp. 12–14, T. I. Jones: 'fire–retardant hydraulic fluids'.

*Primary Examiner*—J. R. Scott

*Attorney, Agent, or Firm*—Antonelli, Terry, Stout & Kraus

[57] ABSTRACT

A switching mechanism for use e.g. in a circuit breaker of an underground electric substation has a movable rod which causes opening and closing of an electrical contact and a hydraulic operating system. The hydraulic operating system uses a hydraulic fluid which has a high flammability temperature or is incombustible. Thus, even if such fluid leaks from the hydraulic operating system, the risk of fire or explosion is minimized. The hydraulic operating system may have a sealed tank for the fluid, preferably with a variable volume expansion chamber. In a further development, the hydraulic operating system and possibly parts of the movable rod, is enclosed in a casing which is sealed and is filled with a gas which does not support combustion therein. Thus, the risk of fire or explosion is further reduced. The casing may have a variable volume expansion chamber.

12 Claims, 6 Drawing Sheets

SWITCH MECHANISM

This application is a continuation application of Ser. No. 08/125,838, filed Sep. 24, 1993, now abandoned, which in turn is a continuation of application Ser. No. 07/761,304, filed Sep. 17, 1991, which is now abandoned.

BACKGROUND OF THE INVENTION

1. Field of the Invention

The present invention relates to a switch mechanism suitable for use in an electrical substation, and to an electrical substation incorporating such a switch mechanism.

2. Summary of the Prior Art

In an electric substation, it is normally necessary to provide a switching mechanism which acts as a circuit breaker for the substation. There are three known types of such switching mechanisms, a first type which operates by spring forces, a second type being a pneumatic system using compressed air, and the third type being a hydraulic system. Spring operated mechanisms are suitable for low voltage circuit breaking, but are not normally suitable for higher voltages. Pneumatic systems have been found to involve excessive maintenance. Hence, particularly in the known puffer-type circuit breaker, requiring a large operating force, hydraulic systems have been developed. An example of such a system is disclosed in JP-A-62-58092.

In existing-hydraulic systems, the hydraulic fluid is mineral oil, and the system is operated at a high pressure of e.g. 300 bars. It should also be noted that it is known to provide an electric substation in which the main circuit conductor is enclosed in an enclosure which is filled with a gas such as sulphur hexafluoride. In existing systems, however, the hydraulic mechanism for activating the movable part of the switching mechanism forming the circuit breaker has been located outside that enclosure. In such circumstances, the hydraulic mechanism may be enclosed in an un-sealed casing, such as disclosed in JP-A-1-220320.

Additionally, in an article entitled "Development of a Perfluorocarbon Liquid Immersed Prototype Large Power Transformer with Compressed $SF_6$ Gas Installation" by Y. Mukaiyama et al. presented at the IEEE/PES 1990 Summer Meeting, Minneapolis, Minn., 90 SM 465-5 PWRD, an arrangement is proposed wherein a transformer, suitable for use in an electric substation uses perfluorocarbon as a cooling liquid surrounding the core of the transformer, with an outer casing containing sulphur hexafluoride.

SUMMARY OF THE INVENTION

Because of the increasing cost of land space, proposals have been made for electric substations to be located underground. However, there is then an increased fire risk if standard circuit breakers are used. Inevitably, the hydraulic system will not be entirely fluid-tight, and then hydraulic fluid will leak. Since the hydraulic fluid may be under pressure, leakage may be in the form of a spray resulting in mineral oil vapor. Such mineral oil vapor is highly combustible, so there is a significant fire risk.

Therefore, a first aspect of the present invention proposes that the hydraulic fluid be one which has a high flammability temperature. Preferably, the hydraulic fluid is incombustible, but fluids can also be used which are not flammable at temperatures likely to be encountered in an electric substation. Normally, fluids with a flammability temperature above 300° C. will be suitable. Using such a high flammability temperature fluid, the risk of fire or explosion due to combustion of leaked hydraulic fluid is significantly reduced. Thus, such hydraulic fluids are particularly advantageous in underground electric substations. However, they may also be used in other electric substations.

In a development of the present invention, the hydraulic system has a tank for the hydraulic fluid which tank is sealed. Without such sealing, there is the risk that hydraulic fluid will evaporate, particularly if some known high flammability temperature fluids are used. However, since such a tank is not normally filled by the hydraulic fluid, there is the problem that the pressure in the tank above the fluid will change due to changes in operating temperature, etc. Therefore, in a further development, the present invention proposes that such a sealed tank has an expansion chamber communicating with the interior thereof, and preferably the volume of that expansion chamber is variable. In this way, pressure changes within the tank above the hydraulic fluid may be absorbed by changes in the volume of the expansion chamber.

As was mentioned above, existing switching mechanisms may have the hydraulic operating system thereof enclosed in a casing, and the second aspect of the present invention proposes that such a casing be sealed and be filled with a gas which does not support combustion therein. In this way, the risk of explosion is further reduced.

Preferably, the first and second aspects of the present invention are combined in a single switch mechanism, but each may be embodied independently, if desired.

Where such a sealed casing is provided, it should enclose at least the hydraulic operating system of the switching mechanism. It may extend further, to enclose at least part of the movable member of the switching mechanism, if desired.

Preferably, the sealed casing contains a sensor for sensing density, pressure and/or temperature of the gas in that casing. If the casing is sealed, there is then the problem that the pressure within it may vary with changes in the operating temperature, and therefore another aspect of the present invention proposes that such a sealed casing has an expansion chamber which preferably has a variable volume. In this way, similar to the expansion chamber of the tank for the hydraulic fluid, changes in pressure may be absorbed by changes in the volume of the expansion chamber.

The hydraulic fluid of high flammability temperature may be perfluorocarbon, silicone oil or hydrocarbon oil. The gas which does not support combustion may be nitrogen, argon, helium or sulphur hexafluoride. It can be noted that the use of perfluorocarbon as the hydraulic fluid gives the further advantage that the kinematic viscosity of perfluorocarbon is about one tenth that of mineral oil. This results in a more rapid flow of the hydraulic fluid and that should give a faster response.

BRIEF DESCRIPTION OF THE DRAWINGS

Embodiments of the present invention will now be described in detail, by way of example, with reference to the accompanying drawings in which.

DETAILED DESCRIPTION

A first embodiment of the present invention will now be described with reference to FIG. 1.

Figure 1:
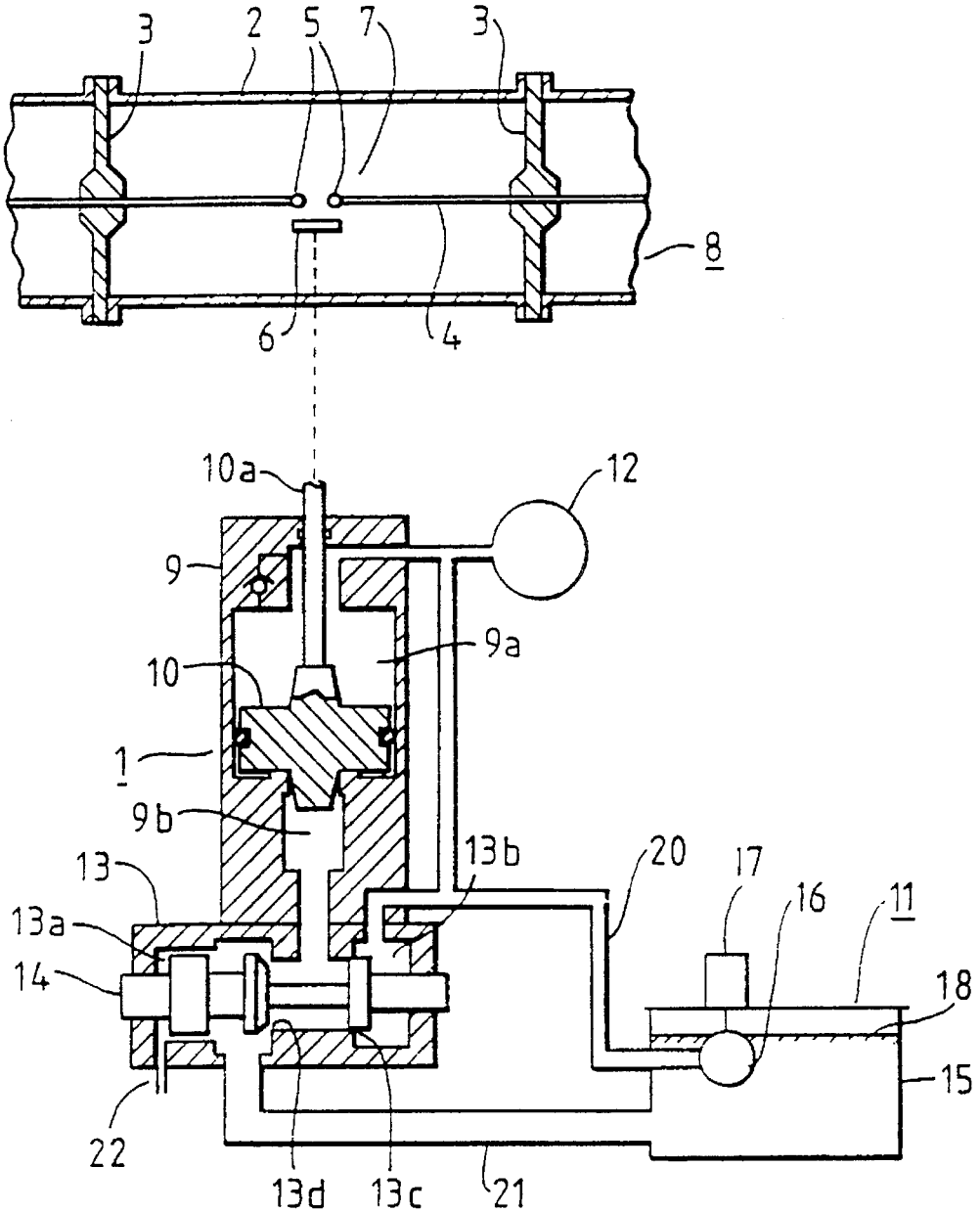
FIG. 1 is a sectional view of a switching mechanism for an electric substation, being a first embodiment of the present invention.

In FIG. 1, a gas insulated switching device 8 forming part of a switch mechanism for an underground substation has an insulating medium such as $SF_6$ gas is sealed in an enclosure in the form of a gas vessel 2 and a main circuit conductor 4 is supported by an insulating material 3 in that vessel 2. A switch section 7 acting as a circuit breaker is provided in at an intermediate portion of the main circuit conductor 4 in electrical series therewith. This switch section 7 has fixed contacts 5 and a moving contact 6. The moving contact 6 is connected to a hydraulic operating device 1 with a rod 10*a* electrically insulated from the main circuit conductor 4, which rod is movable by the hydraulic operating system of the hydraulic operating device 1.

The hydraulic operating device 1 has an operating cylinder 9 slidably fitted over an operating piston 10 connected to a rod 10*a*, a control valve 13 for controlling the operation of this operating cylinder a hydraulic pump 11, an accumulator 12 for storing a high pressure working fluid supplied from this hydraulic pump 11, and pilot valves for open-circuit and for closed-circuit (not shown).

The interior of the operating cylinder 9 is divided by the operating piston 10 into a fluid chamber 9*a* adjacent to the rod 10*a* and a fluid chamber 9*b* adjacent to the control valve 13. The fluid chamber 9*a* is in constant communication with the accumulator 12, while the fluid chamber 9*b* has hydraulic fluid communication thereto switched by the control valve 13 between the hydraulic pump 11, via a low pressure piping 21, and the accumulator 12, via a high pressure piping 20.

A fluid chamber 13*a* of the control valve 13 receives or has removed therefrom a high pressure working fluid serving as the driving force to a spool 14. That supply or removal is controlled by a pilot valve, not shown, and the supply or removal switches the hydraulic fluid communication of the fluid chamber 9*b*.

Furthermore, the hydraulic pump 11 has a fluid tank 15 and a motor 17 for driving a pump 16. The fluid tank 15 is tightly sealed.

The working fluid in the hydraulic operating device is an incombustible fluid such as a perfluorocarbon compound.

FIG. 1 corresponds to the open-circuit state of the switch section 7, in which the fluid chamber 9*a* and the fluid chamber 13*b* of the control valve 13 having its valve seat closed are connected to the accumulator 12 and acted on by a high pressure working fluid, whereby the fluid chamber 9*a* applies a downward force to the operating piston 10, so that the rod 10*a* holds the moving contact 6 in an open-circuit position.

When a closed-circuit command is given the pilot valve (not shown) for the closed-circuit, is actuated and high pressure working fluid flows into the fluid chamber 13*a*, and the spool 14 is driven to the right as illustrated in FIG. 1. As a result, the valve seat 13*d* is closed and the valve seat 13*c* is opened, whereby the fluid chamber 9*b* is connected to the accumulator 12 via the valve seat 13*c*. The operating piston 10 is connected to the rod 10*a*, causing a difference in area between the upper and lower surfaces (the pressure receiving surfaces), so that an upward force is applied and the moving contact 6 is driven by movement of the rod 10a to establish a closed-circuit.

To switch to an open-circuit, high pressure working fluid in the fluid chamber 13*a* is discharged by the pilot valve (not shown) for open-circuit, the spool 14 is driven to the left as illustrated in FIG. 1 to be brought into position shown as illustrated in the figure, the fluid chamber 9*b* communicates with the hydraulic pump 11 via the valve seat 13*d* and a low pressure piping 21, and the operating piston 10 is driven downwardly by the working fluid in the fluid chamber 9*a*.

As described above, an incombustible fluid is used as a working fluid in this hydraulic operating device, whereby, even if the working fluid should flow out of the piping and the sealed portion, the possibility of causing a fire is low and there is little chance that the gas insulated switching device is damaged thereby allowing the insulating medium to flow out. Thus, the switch mechanism may be used in an underground substation with high safety.

Furthermore, in an underground substation, a transformer is provided and connected to the gas insulated switching device. Recently, there has been proposed in the article by Mukaiyana et al, mentioned above, a composite insulating type incombustible transformer using a perfluorocarbon compound for cooling, and $SF_6$ gas as an insulating medium. When perfluorocarbon compound is used as the incombustible fluid, the switch mechanism and the transformer use the same fluid, so that it is economically beneficial and maintenance is facilitated.

It should be noted that complete incombustability is not necessary, provided that the flammability temperature of the hydraulic fluid is sufficiently high that combustion will not occur at the temperatures encountered in an electric substation. It is believed that a flammability temperature above 300° C. is satisfactory. Thus, a fluid with a high flammability temperature (hereinafter 'flame-resistant fluid') such as silicone oil or hydrocarbon oil may be used as the working fluid in the hydraulic operating system, so that the effect is substantially identical with those discussed above can be obtained.

It should also be noted that the kinematic viscosity of mineral oil is $7.5\times10^6$ $m^2/S$, while that of perfluorocarbon is $0.8\times10^6$ $m^2/S$. Hence, the kinematic viscosity of perfluorocarbon is about one tenth that of mineral oil so it should permit the hydraulic operating system to have a fast response time.

Figure 3:
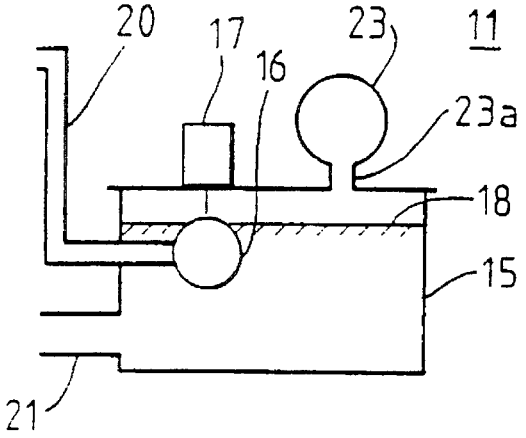
FIG. 3 shows a modified tank which may be used in the embodiment of FIG. 1.

FIG. 3 is a longitudinal sectional view showing part of a switch mechanism for an underground substation being a modification of the first embodiment of the present invention, i.e. a fluid pump 11 modified from that shown in FIG. 1.

Figure 2:
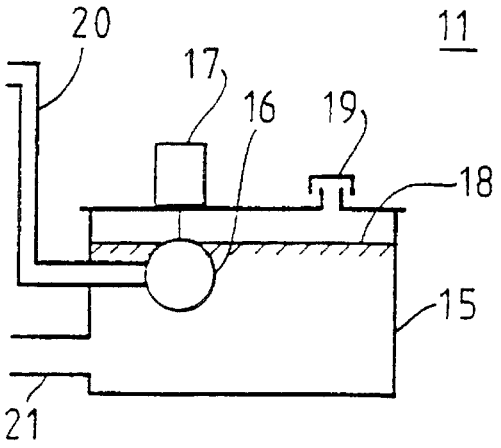
FIG. 2 shows the tank used in a conventional hydraulic system.

For comparison, FIG. 2 shows the conventional fluid pump, a gas intake-discharge opening 19 is formed on the top of the conventional fluid tank 15. However, in FIG. 3, an expansion chamber in the form of an auxiliary vessel 23 is connected to the fluid tank 15 instead of the gas intake-discharge opening 19 so that the fluid tank 15 may have a tightly sealed construction.

When perfluorocarbon compound is used as the working fluid, the boiling point thereof is as low as about 100° C., increasing the probability of evaporation. Therefore, if there is a gas intake-discharge opening 19, as in the prior art, the quantity of fluid will decrease due to evaporation from the surface 18 of the fluid and oxygen deficiency in the underground substation will result due to the evaporated gas. However, the fluid vessel has a tightly sealed construction as shown in FIGS. 1 and 3, so that this disadvantage need not occur, i.e. the fluid vessel is gas-tightly sealed to prevent the evaporated gas from escaping. When the auxiliary vessel 23 is provided, as shown in FIG. 3, the conventional fluid tank can be used with only a small modification. Furthermore, when the level of the liquid surface 18 of the working fluid in the fluid tank 15 varies by the movement of the working fluid during on-off operation or by changes in the environmental temperature, pressure rises in the fluid tank 15. This limits the flow rate from the low pressure piping 21 as illustrated in FIG. 1 for example, and thus the characteristics of the switching operations are adversely affected. However, the addition of the auxiliary vessel 23 as shown in FIG. 3 makes it possible to reduce pressure fluctuations in the fluid tank 15, so that more stable switch operation characteristics can be achieved. It may be noted that the connection **23*a* between the tank 15 and the auxiliary vessel 23** may be varied in length as required.

Figure 4:
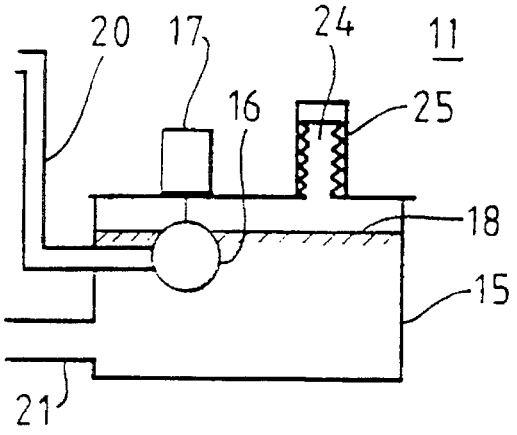
FIG. 4 shows a further modified tank which may be used in the embodiment of FIG. 1.

FIG. 4 is a longitudinal section view showing a fluid pump 11 in which this problem has been further considered. In the arrangement illustrated in FIG. 4, an expandable member 24 such as bellows sealed at the top end thereof is provided on the top of the fluid tank 15, so that a sealed construction is achieved in which the expandable member 24 can expand in the axial direction thereof when the pressure rises in the fluid tank 15. This permits an increase in the effective volume of the fluid tank 15. The expansion or contraction of the expandable member 24 in the axial direction thereof may be guided by a guide member 25.

According to this arrangement, the expandable member 24 follows the pressure fluctuations in the fluid tank 15, so that the pressure fluctuations can be suppressed to obtain stable switch operation. In this arrangement an expandable member 24 expandable or contractible in the axial direction thereof is used. However, any expansion chamber of variable volume, to permit increasing or decreasing of the effective volume of the fluid tank 15 in response to the pressure fluctuations in the fluid tank 15 may be provided.

As has been described hereinabove, according to the first embodiment, an incombustible fluid or a flame-resisting fluid is used as the working fluid in the hydraulic operating system used as part of a switch mechanism for an underground substation. Thus, even if some of the working fluid should leak out, neither a fire nor explosion will result, so that the working fluid is suitable for a gas insulated switching device of an underground substation, since it may provide a more safe switch mechanism for such an underground substation.

Figure 5:
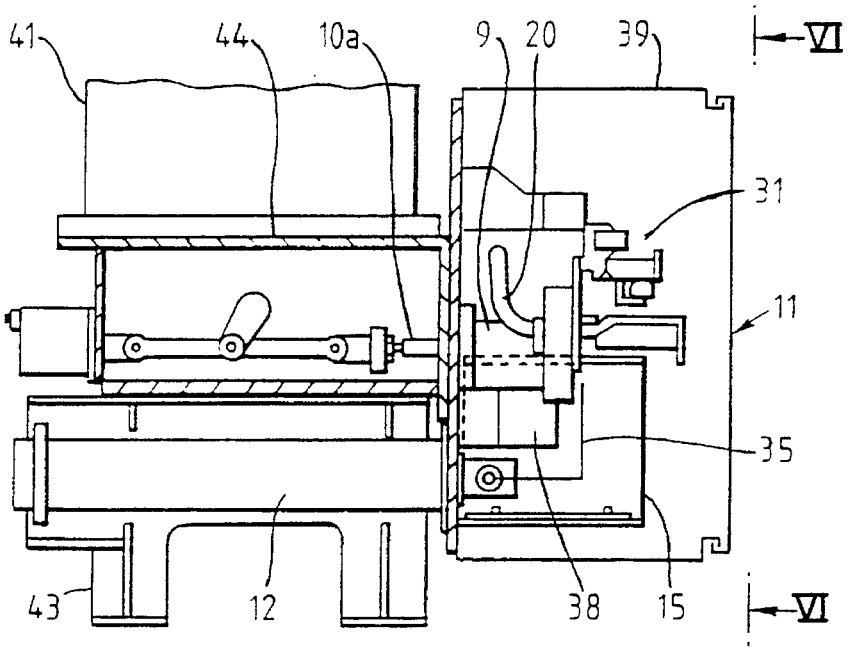
FIG. 5 is a sectional view through a further switching mechanism which may embody the present invention.
Figure 6:
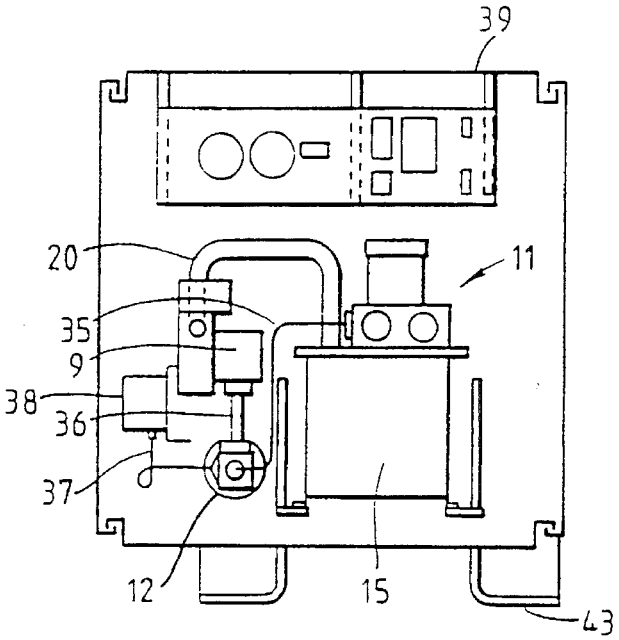
FIG. 6 is a view along the line VI to VI in FIG. 5.

FIGS. 5 and 6 illustrate a second embodiment of the present invention. In FIGS. 5 and 6, components which correspond to components of the first embodiment of FIG. 1 are indicated by the same reference numerals. First, the switch mechanism has a hydraulic operating system comprising an operating cylinder 9, a tank 15 for a hydraulic pump, piping 20, 35, 36, 37, and a pressure switch 38. All these components are located within a casing 39. In the embodiment of FIGS. 5 and 6, the accumulator 12 is located outside the casing 39, but it can be located within that casing 39 if desired.

FIGS. 5 and 6 also illustrate a tank 41 in which the breaker part of a prototype gas circuit breaker is located, a support frame 43, and a casing 44 for the rod **10*a*** which is moved by the hydraulic operating circuit.

It may be noted that the structure of the embodiment of FIGS. 5 and 6 is substantially the same as in JP-A-1-220320. However, according to the present invention, the hydraulic fluid used in the hydraulic operating system thereof has a high flammability temperature, or is incombustible.

If the embodiment of FIGS. 5 and 6 follows the teachings of JP-A-1-220320, the casing 39 is not sealed. Therefore, that casing 39 may contain a mixture of air and hydraulic fluid vapor. If that vapor is incombustible, then there may be no real risk of fire or explosion. If, however, the flammability temperature of the hydraulic fluid is low, then an explosion could occur in the casing 39. Furthermore, any explosion in the casing 39 could damage the enclosure containing the main conductor (see FIG. 1) releasing $SF_6$ gas, and also bringing about oxygen deficiency around the substation.

Thus, the present invention proposes that the casing 39 be sealed, and be filled with a gas which does not support combustion therein. Embodiments in which this is achieved will now be described.

In the subsequent description, references are made to inert and "incombustible" gases. Inert gases do not support combustion and also are non-reactive. However, some gases, such as $SF_6$, which are reactive (and therefore not inert) may still be used in the present invention. "Incombustible" is therefore used in the sense of a gas which does not support combustion therein, rather than in the sense of a gas which itself does not burn.

Figure 7:
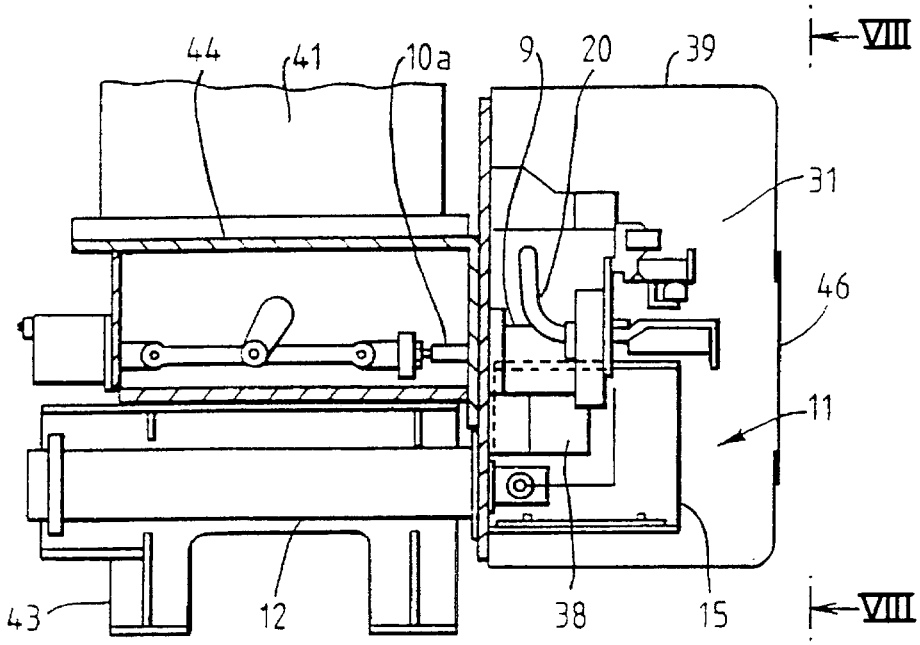
FIG. 7 is a sectional view through a switching mechanism of a third embodiment of the present invention.

FIG. 7 is a side view of third embodiment of the switch mechanism of a gas circuit breaker and the difference between this embodiment and that of FIGS. 5 and 6 is that the casing 39 is sealed and has its hollow interior 31 filled with an inert or incombustible gas. A hand hole for inspecting the interior of the casing 39 may be bored in the casing 39, provided that hole is sealed with a cover 46. This construction prevents fire and explosion hazards because, even if hydraulic fluid leaks out from a joint of piping of the hydraulic operating system or from an oil seal portion, and an ignition source is present, the inert or incombustible gas prevents combustion of the hydraulic fluid.

Examples of suitable inert or incombustible gases include nitrogen, argon and helium. It is also possible to use $SF_6$ which is used generally as an arc quenching and insulating gas for gas insulation electric equipment such as a puffer type gas circuit breaker. Since such an inert or incombustible gas is provided, corrosion of components inside the casing 39 and oxidation and degradation of the hydraulic fluid of the hydraulic operating system can be prevented, as well.

The pressure of the inert or incombustible gas is preferably substantially equal to the atmospheric pressure, so that the casing 39 has sufficient mechanical strength. Thus, leakage of gas from the casing 39 is unlikely and the gas does not influence the hydraulic pump 11 of the hydraulic operating device.

Figure 8:
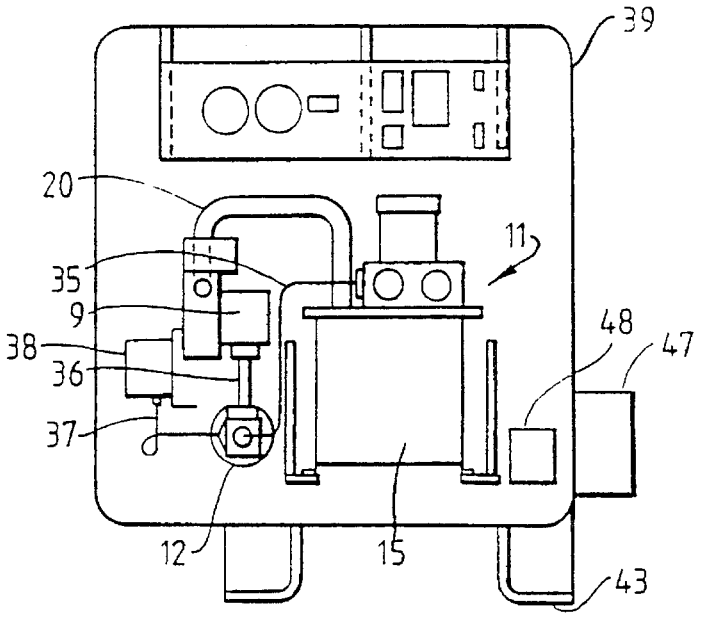
FIG. 8 is an end view of a switching mechanism being a fourth embodiment of the present invention.

FIG. 8 illustrates a fourth embodiment of the present invention, which is generally similar to the third embodiment shown in FIG. 7, when viewed along the line VIII—VIII. Components of the fourth embodiment which correspond to those of the third embodiment are indicated by the same reference numerals. However the fourth embodiment includes an exclusive vacuum pump 47 outside the casing 39. Also, a monitor device 48 for monitoring at least one of the density, pressure and temperature as condition parameters of the gas inside the casing 39 is located in the casing 39. The casing 39 can be filled with inert or incombustible gas by replacing internal air with inert or incombustible gas by causing the latter to flow into the casing 39. However, it is preferable to purge completely the air using the vacuum pump 47 and then to supply the inert or incombustible gas. The provision of vacuum pump 47 improves the work efficiency for inspection. Since there is a monitor device 48 for monitoring at least one of the density, pressure and temperature of the gas inside the casing 39, which monitors the conditions of the gas, reliability of detection of leakage of gas can be improved.

Figure 9:
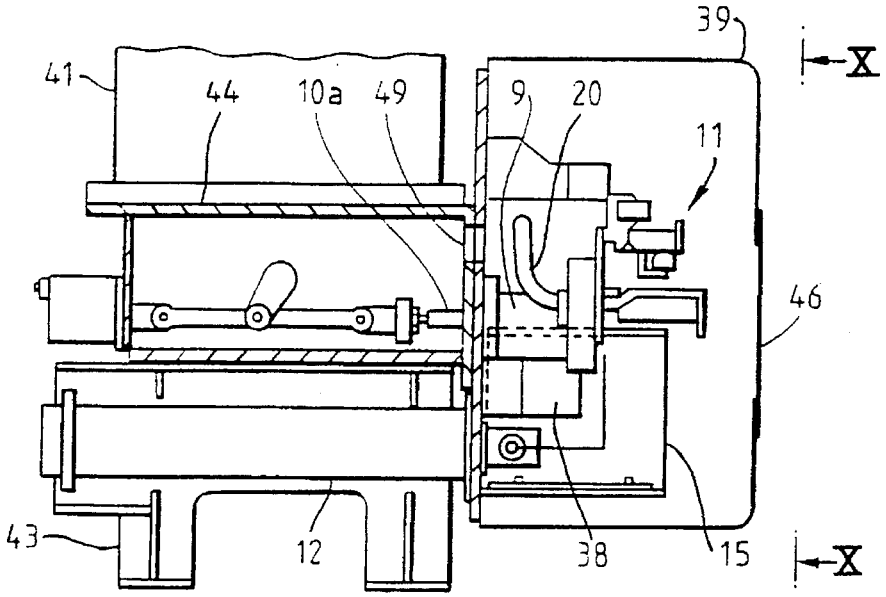
FIG. 9 is a sectional view through a switching mechanism being a fifth embodiment of the present invention.

FIG. 9 illustrates a fifth embodiment of the present invention. Again, this embodiment is similar to the third embodiment and corresponding portions are indicated by the same reference numerals. This embodiment differs from the embodiment shown in FIG. 1 in that there is a communication port 49 between the casing 39 enclosing the hydraulic operating system and the casing 44 enclosing part of the movable member of the switch mechanism. The casing 44 is a sealed container so that it can be filled with an inert, or an incombustible gas can be packed into it. Thus, the casing 39 and the casing 44 form a sealed unit filled with inert or incombustible gas. This construction provides the same advantages as that of the embodiment of FIG. 7, but extended to the casing 44.

Figure 10:
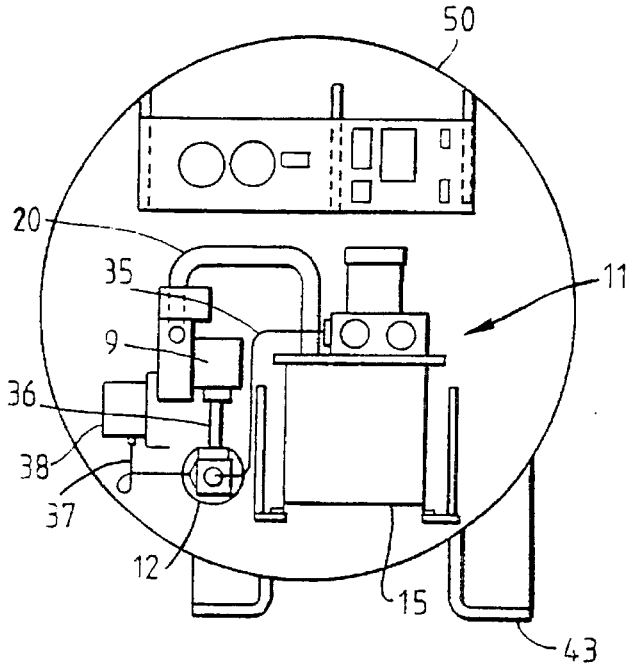
FIG. 10 is an end view of a switching mechanism being a sixth embodiment of the present invention.

FIG. 10 is a side view of a sixth embodiment, generally similar to the embodiment of FIG. 9 viewed along the line X—X. Components which correspond to components of the fifth embodiment of FIG. 9 are indicated by the same reference numerals. In FIG. 10, the casing 50 has a cylindrical form and this arrangement has the advantage that the fabrication of the casing becomes easier than for a square casing. Furthermore, $SF_6$ gas having the same pressure as that of the tank 41 having therein the breaker portion can be used and gas handling inside the casing 50 can be simplified.

Figure 11:
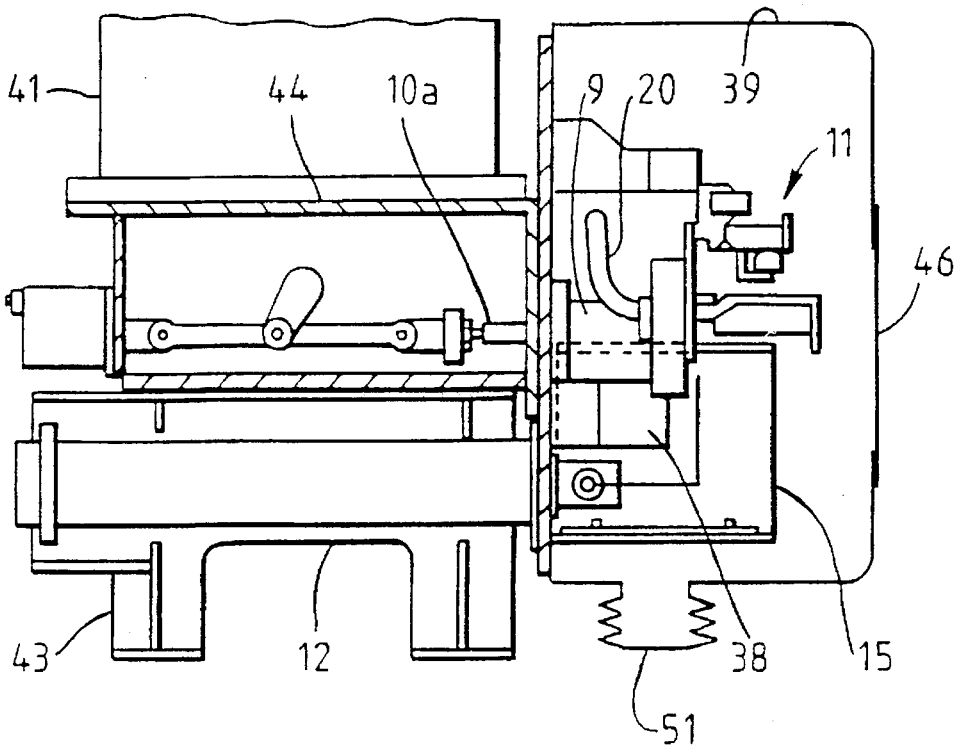
FIG. 11 is a sectional view through a switching mechanism being a seventh embodiment of the present invention.

FIG. 11 shows a seventh embodiment of the present invention. The difference of this embodiment from the foregoing embodiments is that it has a volume varying device for changing automatically the internal volume of the casing 39 in accordance with its internal pressure. The volume varying device in this embodiment consists of bellows 51. Since the internal pressure of the casing 39, despite changes in the ambient temperature, can always be kept at atmospheric pressure, the mechanical strength of the casing 39, does not have to be excessively high.

In accordance with the third to seventh embodiments of the present invention, the hydraulic operating system is enclosed within a sealed casing which is filled with an inert or incombustible gas. Accordingly, even if an oil leak occurs from the hydraulic operating device and at the same time there is an ignition source, the occurrence of fire and explosion hazards can be prevented.

The third to seventh embodiment of the present invention may use a hydraulic fluid with a high flammability temperature, as in the first and second embodiments. However, since the risk of fire or explosion is minimized even if a leak occurs, the third to seventh embodiments may use mineral oil.

What is claimed is:

1. A hydraulically-operated switch mechanism for an electric switching device, comprising a movable member movable to cause movement of an electrical contact of the switching device for opening and closing of an electrical circuit of the switching device, and a hydraulic operating system for moving said movable member, said hydraulic operating system having a hydraulic operating device connected to said movable member for moving said movable member, hydraulic fluid for use as a working fluid for operating the hydraulic operating device, and means for supplying the working fluid to the operating device for operating the device, wherein said working fluid has a flammability temperature above 300° C., and wherein said working fluid is incombustible.

2. A switch mechanism according to claim 1, wherein said working fluid which is incombustible is perfluorocarbon.

3. A switch mechanism according to claim 1, wherein said hydraulic operating device comprises an operating cylinder, an operating piston slidably fitted in said operating cylinder, a fluid tank for reserving said working fluid, a hydraulic pump fluidly connected to said operating cylinder for supplying said operating cylinder with said working fluid in said fluid tank, and a control valve for controlling fluid flow between said operating cylinder and said fluid tank.

4. A hydraulically-operated switch mechanism for an electric switching device, comprising a movable member movable to cause movement of an electrical contact of the switching device for opening and closing of an electrical circuit of the switching device, and a hydraulic operating system for moving said movable member, said hydraulic operating system having a hydraulic operating device connected to said movable member for moving said movable member, hydraulic fluid for use as a working fluid for operating the hydraulic operating device, and means for supplying the working fluid to the operating device for operating the device, wherein said means for supplying the working fluid includes a pump which during pumping receives relatively low pressure working fluid and supplies relatively high pressure working fluid to the operating device and a gas-tightly sealed tank containing, said relatively low pressure working fluid to be received and pumped by said pump, said gas-tightly sealed tank having an expansion chamber communicating with the interior of said tank for suppressing an increase in pressure in said tank, the volume of said expansion chamber being variable.

5. A switch mechanism according to claim 4, in combination with said electric switching device, and wherein said electrical switching device and said switch mechanism are part of an underground electric substation.

6. A hydraulically-operated switch mechanism for an electric switching device, comprising a movable member movable to cause movement of an electrical contact of the switching device for opening and closing of an electrical circuit of the switching device, a hydraulic operating system for moving said movable member and thereby said electrical contact for opening and closing an electrical circuit of the switching device, said hydraulic operating system having: a hydraulic operating device connected to said movable member for moving said movable member, hydraulic fluid for use as a working fluid for operating the hydraulic operating device, and means for supplying the working fluid to the operating device for operating the device; and said hydraulically-operated switch mechanism further comprising a hollow, gas-tightly sealed casing enclosing at least said hydraulic operating system in its entirety, said hollow, gas-tightly sealed casing being filled with a gas which does not support combustion therein.

7. A switch mechanism according to claim 6, wherein said gas is selected from a group consisting essentially of nitrogen, argon, helium and sulphur hexafluoride.

8. A switch mechanism according to claim 6, wherein said hydraulic operating device comprises an operating cylinder, an operating piston slidably fitted in said operating cylinder, a fluid tank for reserving said working fluid, a hydraulic pump fluidly connected to said operating cylinder for supplying said operating cylinder with said working fluid in said fluid tank, and a control valve for controlling fluid flow between said operating cylinder and said fluid tank, all of which are enclosed in said hollow sealed casing.

9. A switch mechanism according to claim 6, in combination with said electric switching device, and wherein said electrical switching device and said switch mechanism are part of an underground electric substation.

10. The underground electric substation according to claim 5, wherein said working fluid is perfluorocarbon.

11. A switch mechanism according to claim 4, wherein said working fluid is perfluorocarbon.

12. A switch mechanism according to claim 6, wherein said working fluid is perfluorocarbon.

* * * * *